US010029507B2

(12) United States Patent
van den Berg

(10) Patent No.: US 10,029,507 B2
(45) Date of Patent: Jul. 24, 2018

(54) IDENTITY DOCUMENT AND METHOD FOR THE MANUFACTURE THEREOF

(75) Inventor: Jan van den Berg, Gouda (NL)

(73) Assignee: SDU Identification B.V., Haarlem (NL)

( * ) Notice: Subject to any disclaimer, the term of this patent is extended or adjusted under 35 U.S.C. 154(b) by 377 days.

(21) Appl. No.: 11/918,412

(22) PCT Filed: Apr. 13, 2006

(86) PCT No.: PCT/NL2006/050085

§ 371 (c)(1),
(2), (4) Date: Dec. 22, 2008

(87) PCT Pub. No.: WO2006/110038

PCT Pub. Date: Oct. 19, 2006

(65) Prior Publication Data

US 2009/0214105 A1 Aug. 27, 2009

(30) Foreign Application Priority Data

Apr. 14, 2005 (NL) ..... 1028776

(51) Int. Cl.

| | |
|---|---|
| ***G09F 19/14*** | (2006.01) |
| ***B42D 25/435*** | (2014.01) |
| ***B42D 25/309*** | (2014.01) |
| ***B42D 25/23*** | (2014.01) |
| ***G07C 9/00*** | (2006.01) |
| ***B42D 25/41*** | (2014.01) |
| ***B42D 25/00*** | (2014.01) |
| *B41M 5/24* | (2006.01) |
| *B41M 5/26* | (2006.01) |

(52) U.S. Cl.

CPC ..... *B42D 25/435* (2014.10); *B42D 25/00* (2014.10); *B42D 25/23* (2014.10); *B42D 25/309* (2014.10); *B42D 25/41* (2014.10); *G07C 9/00079* (2013.01); *B41M 5/24* (2013.01); *B41M 5/26* (2013.01); *B42D 2033/24* (2013.01); *B42D 2035/06* (2013.01); *B42D 2035/20* (2013.01)

(58) Field of Classification Search

CPC ..... G09F 19/14; G03B 25/02; B42D 25/435; B42D 25/23; B42D 25/309; B24D 25/41

USPC ..... 40/454; 359/619, 463; 283/93

See application file for complete search history.

(56) References Cited

U.S. PATENT DOCUMENTS

| | | | | |
|---|---|---|---|---|
| 4,920,039 | A * | 4/1990 | Fotland et al. | 430/324 |
| 5,581,402 | A * | 12/1996 | Taylor | 359/463 |
| 6,016,225 | A * | 1/2000 | Anderson | 359/619 |
| 6,329,987 | B1 * | 12/2001 | Gottfried et al. | 345/419 |

(Continued)

FOREIGN PATENT DOCUMENTS

| | | |
|---|---|---|
| DE | 8529297 | 12/1987 |
| EP | 0219012 | 4/1987 |

(Continued)

*Primary Examiner* — Syed A Islam
(74) *Attorney, Agent, or Firm* — The Webb Law Firm

(57) ABSTRACT

Identity document comprising a data medium with data. These data comprise an image of a face. This image consists of two component images that are observed at different angles. By simultaneously viewing the two images, the person studying the identity document can obtain further information about the face. This is possible because the two images are applied at a relatively small angle of 5° to 20°.

5 Claims, 2 Drawing Sheets

(56) References Cited

U.S. PATENT DOCUMENTS

| | | | | |
|---|---|---|---|---|
| 6,922,201 | B2 * | 7/2005 | Blish et al. | 345/646 |
| 7,333,268 | B2 * | 2/2008 | Steenblik et al. | 359/619 |
| 2003/0183695 | A1 * | 10/2003 | Labrec et al. | 235/487 |
| 2006/0023197 | A1 * | 2/2006 | Joel | 355/77 |
| 2008/0284157 | A1 * | 11/2008 | Muke | B41M 3/14 283/86 |

FOREIGN PATENT DOCUMENTS

| | | |
|---|---|---|
| EP | 0323108 | 7/1989 |
| EP | 0590498 | 4/1994 |

* cited by examiner

IDENTITY DOCUMENT AND METHOD FOR THE MANUFACTURE THEREOF

BACKGROUND OF THE INVENTION

1) Field of the Invention

The present invention relates to an identity document comprising a data medium with data, said data comprising two images, said images being applied offset relative to one another and overlapping one another in an image layer sensitive to laser light, wherein a layer comprising a (laser) light-permeable material and forming a lens array is applied to said image layer, wherein said images are applied in such a way that when viewed at a first angle to said data medium the first image is visible and when viewed at a second angle said second image is visible.

2) Description of Related Art

An identity document of this type is disclosed in EP 0219012 A1. In this publication an authentication mark is described consisting of two or three images that are engraved by laser light through a lens structure in a layer sensitive to laser light. By holding the card or other data medium in question at a different angle, one of the images can always be seen. The angle at which the different images are applied is +27°, 0° and −27°, respectively. This provides added security for an identity document such as a passport, driving license and the like. However, for the user, i.e. the person checking the identification document, it is not always clear that such different images are present. Moreover, at certain checkpoints there is little time to check all the authentication marks in an identity document, as a result of which checking for the presence of the different images is overlooked. As a result, the authentication marks are not always optimally used under normal circumstances.

An identity document provided with a lens structure is disclosed in EP 0 323 108. By viewing at different angles, different images can be seen.

An identity card wherein two different images can also be seen by tilting the card is disclosed in DE 8529297U.

The aim of the present invention is to provide an identity document with a primary authentication mark, i.e. a simple authentication mark that is immediately recognisable by the user without further aids and where the user also knows how this mark has to have been made.

This aim is realised in an identity document described above in that said images comprise two images of the same face observed at different angles, said images are being in such a way and said lenses of the lens array are made in such a way that the distance between said first and second angle is 5°-20°.

SUMMARY OF THE INVENTION

According to the present invention two completely different images are no longer engraved in a layer sensitive to laser light at a relatively large angle, but two mutually dependent images are applied in the layer sensitive to laser light at a relatively limited angle. That is to say the same face can be seen by tilting at two different angles. This has the consequence that, in the observation position of the user, i.e. the inspecting person, both images can be registered by the user at the same time so that effect of depth is created. As a result, the angle is relatively limited compared with the state of the art. The angle described above is preferably between 10° and 15° and is more particularly about 12°. These values apply for an average viewing distance between the user and the identity document of about 30-40 cm.

When checking the identity document, the user will always be inclined to study the image applied thereon of the face of the holder of the identity document. He will automatically see the two different images that in this way form (in his mind) a perspective picture of the face of the person being checked. This action occurs as a reflex. If there is only one image, this will be immediately noticeable to the inspecting person and if there is an error between the two images this will be recognisable to the inspecting person at first sight.

It will be understood that three or more images can be used instead of two images. This aspect is dependent on the desired pixel spacing and the desired pixel size in the layer sensitive to laser light.

Because in principle an image is created of the same face at a different angle and this image is engraved in the layer sensitive to laser light, according to an advantageous embodiment an image correction, for the perspective image obtained, is applied in at least one of said images in order that when said two images are combined a natural transition is obtained. That is to say a correction for the perspective distortion has to be introduced.

With certain means of identification, such as when using cards, there are international regulations concerning the total thickness of such a card. In such a case the diameter of the individual lenses and hence the thickness of the layer forming a lens array must be about 100-400 μm and more particularly 150-250 μm. It will be understood that the layer forming a lens array can consist of any type of lenses. For instance, it is possible to apply a number of adjacent cylindrical lenses and it is also possible to provide a set of (partially) spherical lenses.

The layer sensitive to laser light can in principle be any layer that can be engraved using laser light. Polycarbonate with carbon is such a material that under the influence of a laser bundle can be easily blackened or provided with a different colour.

The present invention also relates to a method for the production of an identity document comprising a data medium with data consisting of an image layer and a layer forming a lens array applied thereon, wherein said data comprise two images, which images are engraved using a laser beam in an image layer sensitive to laser light offset relative to one another and overlapping in said image layer with said layer forming a lens array applied thereon in such a way that when viewed at a first angle to said data medium a first image is visible and when viewed at a second angle said second image is visible, wherein said two images are obtained by the provision of two images of a face observed at different angles and said images are applied in such a way and said lenses of the lens array are made in such a way that the distance between said first and second angle is 5°-20°.

The two or more different images can be obtained by various methods known in the state of the art. According to a preferred embodiment an image of a face is always generated with two cameras, i.e. from two observation points. According to a particular embodiment this image is produced by the authority issuing the card. That is to say, the holder of the card does not have to obtain the images him-/herself.

Another method of providing an image is the use of a special lens system with which two images can be produced from a single viewing point. This can be performed optically, but it is also possible to achieve this with software. That is to say, two images are created by projection of the working area.

In all cases it may be desirable to apply a perspective correction. This alternative method of providing the images is also performed according to a preferred embodiment by the card-issuing authority.

The identity document preferably comprises a passport and more particularly a card-like part incorporated in a passport.

BRIEF DESCRIPTION OF THE DRAWINGS

The invention will be explained in more detail below with reference to an illustrative embodiment shown in the drawing, in which.

DETAILED DESCRIPTION OF THE INVENTION

Figure 1:
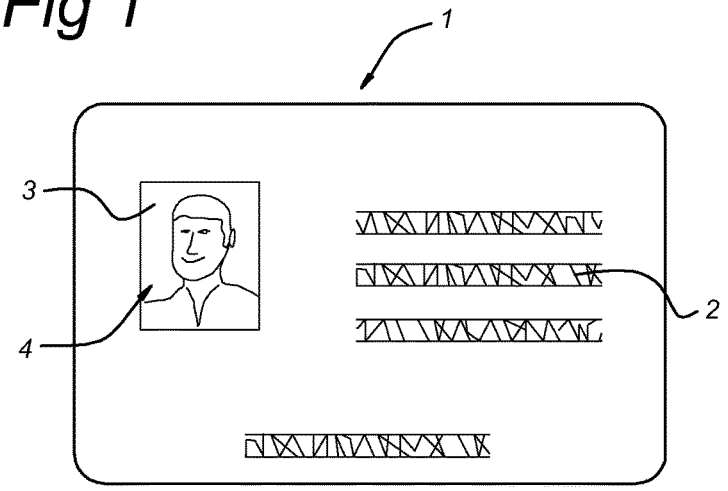
FIG. 1 shows diagrammatically an identity document according to the invention.

In FIG. 1 a means of identification such as a card is indicated in its entirety by 1. A card of this type is also referred to as a data medium. On this card the data on the (legitimate) holder are indicated by 2 as well as a photograph by 3. This photograph 3 consists of a composite image 4.

Figure 2:
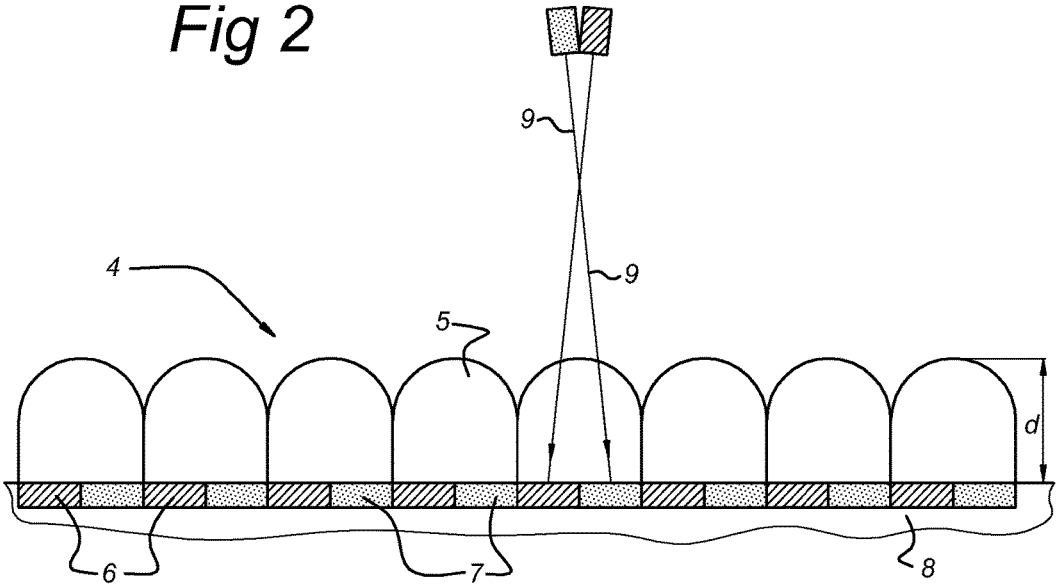
FIG. 2 shows in detail in section the photographic image in FIG. 1.

Details of this composite image can be seen in FIG. 2. There is a lens structure 5 consisting of (semi-)cylindrical lenses. The diameter of the lens structure is 100-400 μm and in this example about 120 μm. The length of the centre-line of the lenses is approximately equal to the thickness d.

It can be seen in FIG. 2 that there are different mutually offset images 6 and 7. These are realised by engraving with a laser beam 9 that is positioned at different angles and first engraves information relating to image 6 and then engraves information relating to image 7 at a second angle.

According to the present invention, images 6 and 7 relate to the same object and more particularly to the face of the holder of the identity document seen from different angles. The maximum mutual offsetting of the images 6 and 7 is 50% of the lens diameter of the lens structure 5 and more particularly about 30%. If more than two images are used, the offset between the separate images will be less.

The image is engraved in a layer 8 sensitive to laser light. This is preferably a polycarbonate material. The same material is preferably used for the lens structure 5.

Figure 3:
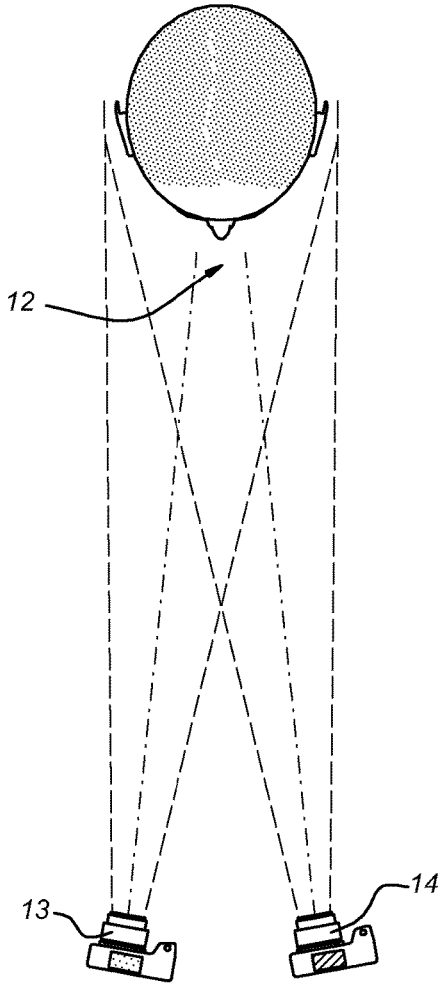
FIG. 3 shows an example for producing the image according to FIG. 2.

FIG. 3 shows how such a composite image assembly 4 is obtained. The face of the holder of the identity document is indicated by 12, a first camera by 13 and a second camera by 14. In FIG. 3 it can be seen that the face of the holder is recorded from two different angular positions.

Subsequently a perspective correction is performed in some way so that the two images are comparable to one another.

Figure 4:
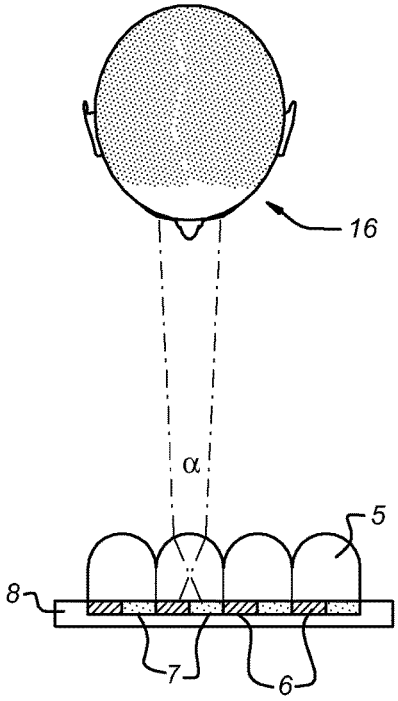
FIG. 4 shows the viewing of the identity document according to FIG. 1.

FIG. 4 shows how an observer 16 views the two images 6 and 7 simultaneously. Owing to the relatively small angle α, which lies between 10° and 20° and more particularly between 10° and 15° and more particularly is about 12°, the observer 16 is able to view image 6 with his left eye and image 7 with his right eye. As a result, an image of the face of the holder 12 is formed in the mind of the viewer that contains depth information. In order to optimise this image it is necessary to apply the perspective correction described above. Such a perspective correction can be performed either during observation with the aid of the cameras 13 and 14 or during the processing of the two images or during engraving in the layer 8 sensitive to laser light.

It will be understood that it is possible to obtain the two or more desired images in another way than that shown in FIG. 3.

In the light of the above, variants will be immediately apparent to those skilled in the art that are obvious in the light of the above description and fall within the scope of the appended claims.

The invention claimed is:

1. A passport comprising:

a data medium including a single portrait photograph, wherein the single portrait photograph consists of a composite portrait image, wherein the composite portrait image includes a single primary authentication mark that is immediately recognizable by a user as the single primary authentication mark without further aids, the composite portrait image comprising at least three composing portrait images of equal size of a face of a person, wherein said composing portrait images comprise blackened material in a polycarbonate image layer, wherein the polycarbonate image layer is sensitive to laser light, wherein the composing portrait images are offset relative to one another in the polycarbonate image layer, overlap one another in the polycarbonate image layer, and form the composite portrait image in the polycarbonate image layer sensitive, wherein a polycarbonate lens layer comprising a laser light-permeable material and a lens array is on said image layer, wherein when said composing portrait images are viewed at a first angle to said data medium, the first composing portrait image is visible, and wherein when viewed at a second angle and a third angle, said second composing portrait image and said third composing portrait image are visible, the composing portrait images comprising at least three identical images of the same person at different angles, wherein the composing portrait images comprise at least three different sides of the same face of the same person, such that in a perpendicular observation position of an observer at a viewing distance of between 30 cm and 40 cm two composing portrait images are registered at the same time, wherein the composing portrait images comprise a depth effect and only a single composite portrait image such that the observer is provided with a view of one image in the left eye of the observer and a view of another image in the right eye of the observer to provide the effect of depth and only the single composite portrait image to the observer, wherein said composing portrait images comprise an angular distance between adjacent images between 10° and 15° for an average viewing distance of about 30 cm to about 40 cm, wherein the average viewing distance comprises a plurality of viewing angles allowing two of the composing portrait images to be viewed simultaneously, wherein the single primary authentication mark consists of only the two of the composing portrait images simultaneously viewable at one of the plurality of viewing angles, wherein no other image including the other composing portrait image is included in the single primary authentication mark at the one of the plurality of viewing angles, wherein the lens array comprises semi-cylindrical lenses having longitudinal cylinder axes aligned with a plane of symmetry of the face, and wherein the face is the face of a holder of the identity document, wherein said composing portrait images comprise laser beam engraved images engraved by laser beam engraving in the image layer sensitive to laser light by a laser beam through the lens array comprising the semi-cylindrical lenses having longitudinal cylinder axes aligned with a plane of symmetry of the face, wherein at least one composing portrait image of the face comprises a perspective correction, wherein the perspective correction provides a transition correction between the composing portrait images in the perspective image such that the composing portrait images, when combined to form the perspective image, are comparable, and a correction for the perspective distortion of the laser beam engraving is made.

2. The identity document according to claim 1, wherein the layer forming the lens array has a diameter of 100-400 μm.

3. The identity document according to claim 1, comprising a card-like data medium.

4. A method for the production of a passport comprising:

forming, in a data medium of the passport, a single portrait photograph that consists of a composite portrait image, wherein the composite portrait image includes a single primary authentication mark that is immediately recognizable by the user as the single primary authentication mark without further aids, the composite portrait image comprising at least three composing portrait images of equal size of a face of a person, wherein said forming comprises:

applying a lens array comprising semi-cylindrical lenses having longitudinal cylinder axes aligned with a plane of symmetry of the face to a polycarbonate image layer, wherein the lens array comprises a polycarbonate lens layer comprising a laser light-permeable material;

applying said composing portrait images offset relative to one another and overlapping one another in the polycarbonate image layer sensitive laser light, wherein said applying said composing portrait images comprises:

engraving said composing portrait images with laser beam engraving in the polycarbonate image layer sensitive to laser light by a laser beam through the lens array comprising the semi-cylindrical lenses having the longitudinal cylinder axes aligned with the plane of symmetry of the face, wherein the engraving comprises blackening the polycarbonate image layer, and applying a perspective correction in at least one composing portrait image of the face, wherein the perspective correction provides a transition correction between the composing portrait images in the perspective image such that the composing portrait images, when combined to form the perspective image, are comparable, and a correction for the perspective distortion of the laser beam engraving is made;

wherein said composing portrait images are applied in such a way that when viewed at a first angle to said data medium, the first composing portrait image is visible, and when viewed at a second angle and a third angle, said second composing portrait image and said third composing portrait image are visible, the composing portrait images comprising at least three identical images of the same face of the same person, taken from different angles, showing at least three different sides of the same face of the same person, such that in a perpendicular observation position of an observer at a viewing distance of between 30 cm and 40 cm two composing portrait images are registered at the same time, the observer being able to view one image with his left eye and another image with his right eye, so that the effect of depth is created and only a single composite portrait image is presented to the observer, wherein said composing portrait images are applied in such a way and said lenses of the lens array are made in such a way that the angular distance between adjacent images is between 10° and 15° for an average viewing distance of about 30 cm to about 40 cm, wherein the distance comprises a plurality of viewing angles allowing two of the images to be viewed simultaneously, wherein the single primary authentication mark consists of only the two of the composing portrait images simultaneously viewable at one of the plurality of viewing angles, wherein no other image including the other composing portrait image is included in the single primary authentication mark at the one of the plurality of viewing angles, wherein the lens array comprises semi-cylindrical lenses having longitudinal cylinder axes aligned with a plane of symmetry of the face.

5. The method according to claim 4, wherein said different images are obtained by registering said object at different angles.

* * * * *